US012408801B2

(12) United States Patent
Tamez

(10) Patent No.: US 12,408,801 B2
(45) Date of Patent: Sep. 9, 2025

(54) PORTABLE TOILET

(71) Applicant: Ronald Tamez, Lake Forest, CA (US)

(72) Inventor: Ronald Tamez, Lake Forest, CA (US)

( * ) Notice: Subject to any disclaimer, the term of this patent is extended or adjusted under 35 U.S.C. 154(b) by 154 days.

(21) Appl. No.: 18/229,903

(22) Filed: Aug. 3, 2023

(65) Prior Publication Data

US 2025/0040768 A1 Feb. 6, 2025

(51) Int. Cl.
*A47K 11/04* (2006.01)

(52) U.S. Cl.
CPC ..... *A47K 11/04* (2013.01)

(58) Field of Classification Search
None
See application file for complete search history.

(56) References Cited

U.S. PATENT DOCUMENTS

| | | | | |
|---|---|---|---|---|
| 1,908,821 | A | 5/1933 | Cornell, Jr. | |
| 3,183,023 | A | 5/1965 | Morrison | |
| 3,570,016 | A * | 3/1971 | Ellis et al. | A47K 11/035 4/348 |
| 3,669,473 | A | 6/1972 | Martin | |
| 4,163,294 | A * | 8/1979 | Patterson | A47K 11/02 D25/16 |
| D334,050 | S | 3/1993 | Foxlee | |
| 6,543,484 | B1 * | 4/2003 | Highsmith | B65H 75/4486 137/355.2 |
| 7,441,810 | B2 | 10/2008 | Buff | |
| 8,752,218 | B2 * | 6/2014 | Mathieson | A47K 11/02 4/144.1 |
| 2017/0074438 | A1 | 3/2017 | Poyser | |
| 2021/0071797 | A1 | 3/2021 | Gage | |

FOREIGN PATENT DOCUMENTS

| | | |
|---|---|---|
| CA | 1189550 | 6/1985 |

* cited by examiner

*Primary Examiner* — Christine J Skubinna

(57) ABSTRACT

A portable toilet for disposing evacuated body waste includes an outhouse comprising a housing and a waste tank. The waste tank is mounted in the housing and defines a waste chamber therein. An adapter drain is mounted to the bottom of the housing. The adapter drain comprises a tube which is configured to be in fluid communication with a sewer cleanout pipe such that the tube facilitates draining waste from the waste chamber to the sewer cleanout pipe.

6 Claims, 6 Drawing Sheets

PORTABLE TOILET

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to portable toilets and more particularly pertains to a new portable toilet for disposing evacuated body waste.

(2) Description of Related Art Including Information Disclosed Under 37 CFR 1.97 and 1.98

Conventional portable toilets collect body waste in a storage tank which is emptied at a location remote from the site where the toilets collect the body waste. However, costs arise from transporting and dumping accumulated body waste contained in portable toilets. Individuals who use portable toilets at sites where new houses or other buildings are being constructed typically have access to a sewer system via a sewer cleanout pipe, which is a vertical pipe typically located on residential lawns as a means of accessing drainage pipes leading to a sewer system. The prior art fails to describe a portable toilet which is constructed to be in fluid communication with the sewer cleanout pipe so that body waste is drained away from the portable toilet, which would reduce or eliminate the costs listed above.

BRIEF SUMMARY OF THE INVENTION

An embodiment of the disclosure meets the needs presented above by generally comprising an outhouse comprising a housing and a waste tank. The housing defines an interior space with a size such that the housing is configured for containing a user. The waste tank is mounted at a bottom of the housing and defines a waste chamber therein. The waste tank has an inlet hole extending downwardly through an upper surface of the waste tank to the waste chamber. An adapter drain is mounted to the bottom of the housing. The adapter drain comprises a tube defining a channel which is in fluid communication with the waste chamber. The tube has an open distal end with respect to the housing which is configured to be in fluid communication with a sewer cleanout pipe such that the tube facilitates draining waste from the waste chamber to the sewer cleanout pipe.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
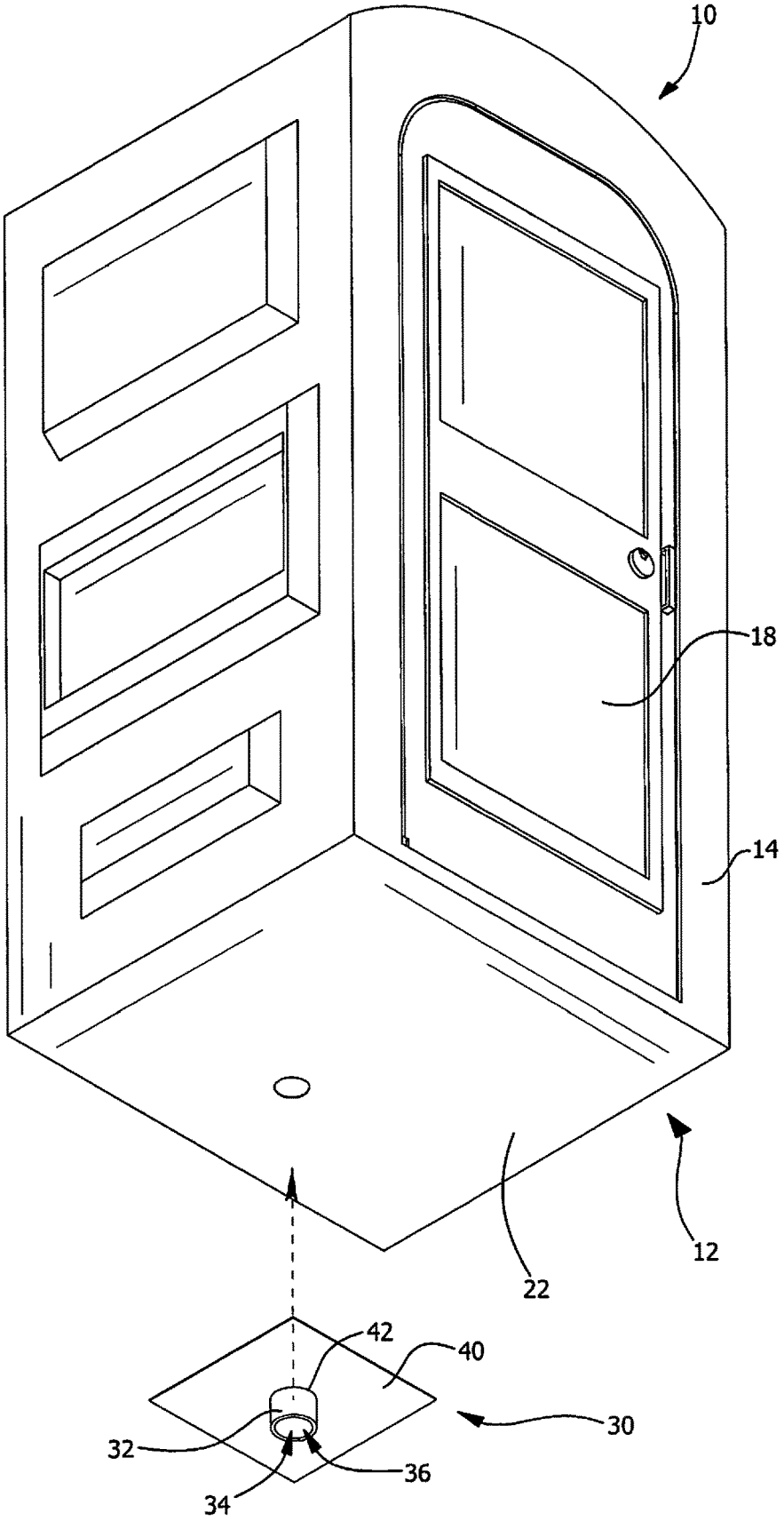
FIG. 1 is a bottom exploded perspective view of a portable toilet according to an embodiment of the disclosure.
Figure 2:
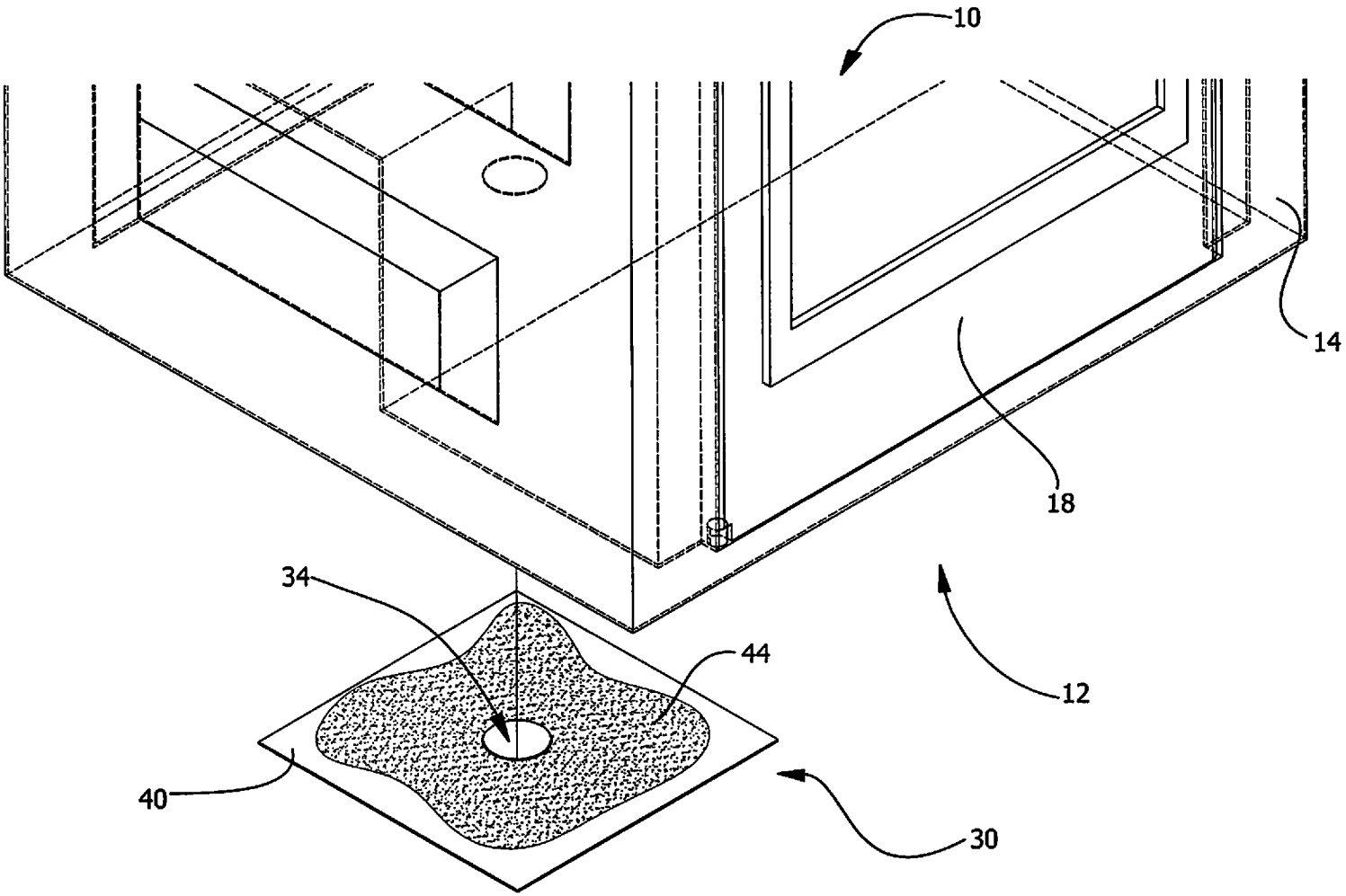
FIG. 2 is a bottom exploded perspective view of an embodiment of the disclosure.
Figure 3:
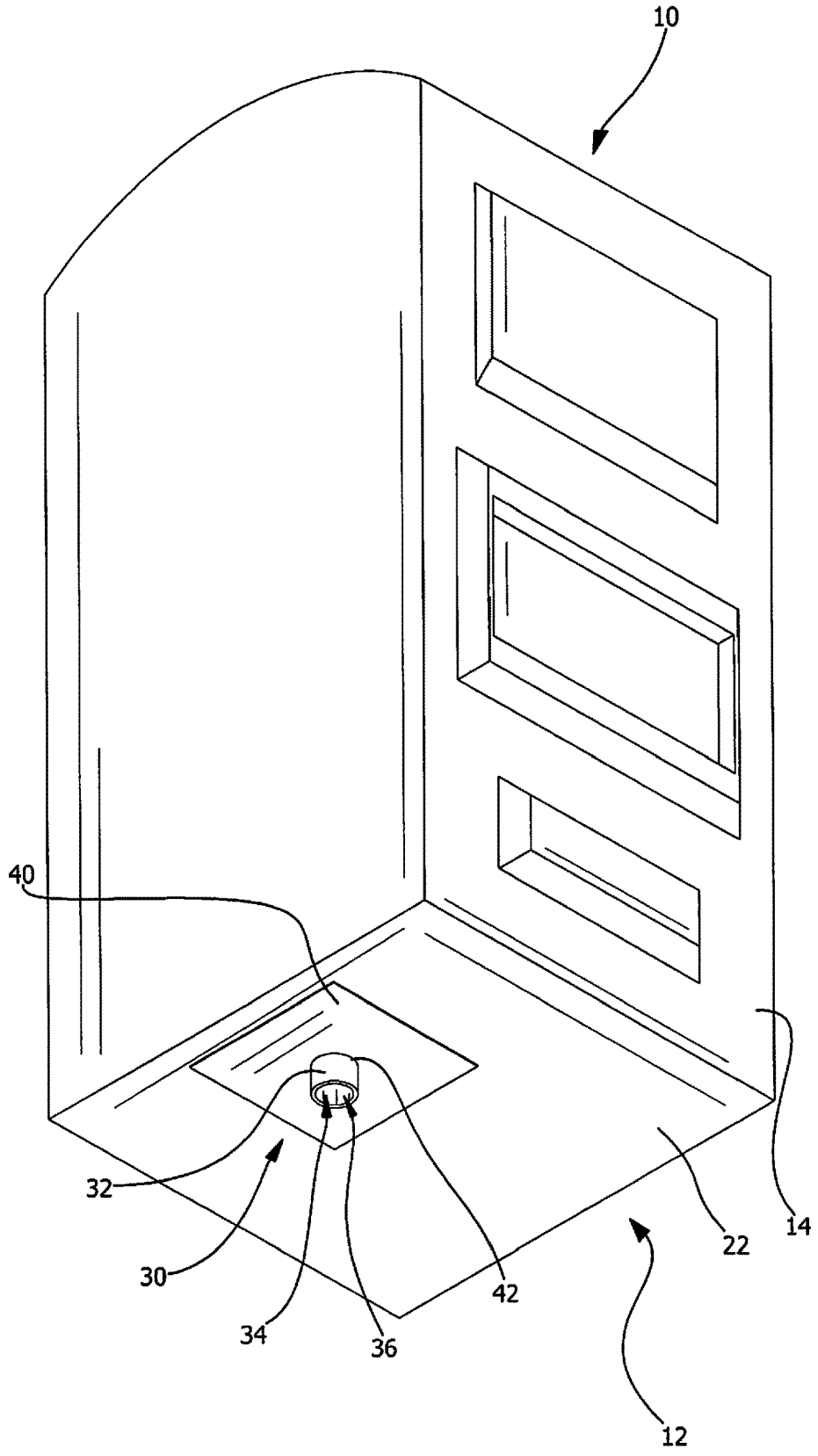
FIG. 3 is a bottom perspective view of an embodiment of the disclosure.
Figure 4:
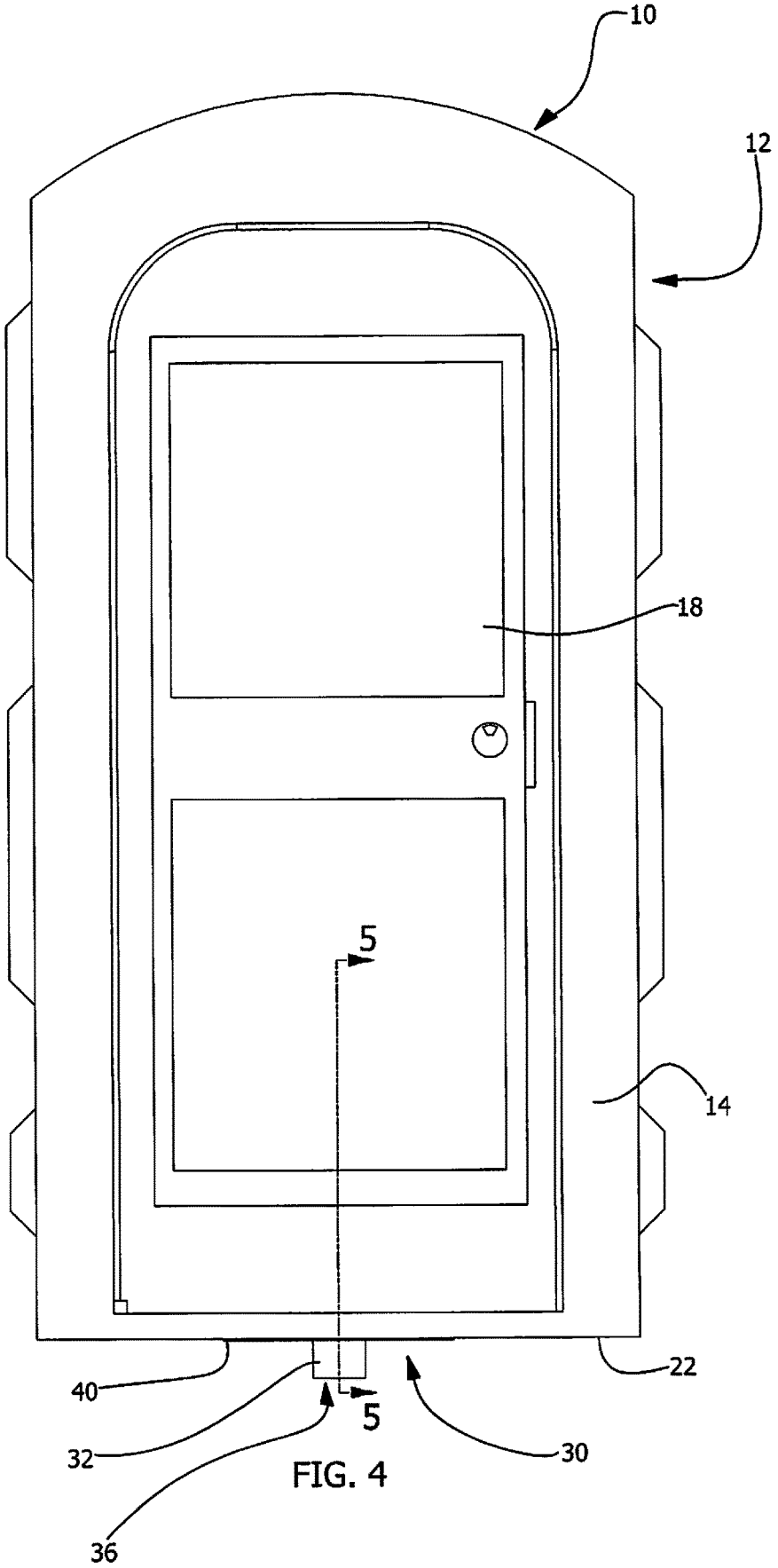
FIG. 4 is a front view of an embodiment of the disclosure.
Figure 5:
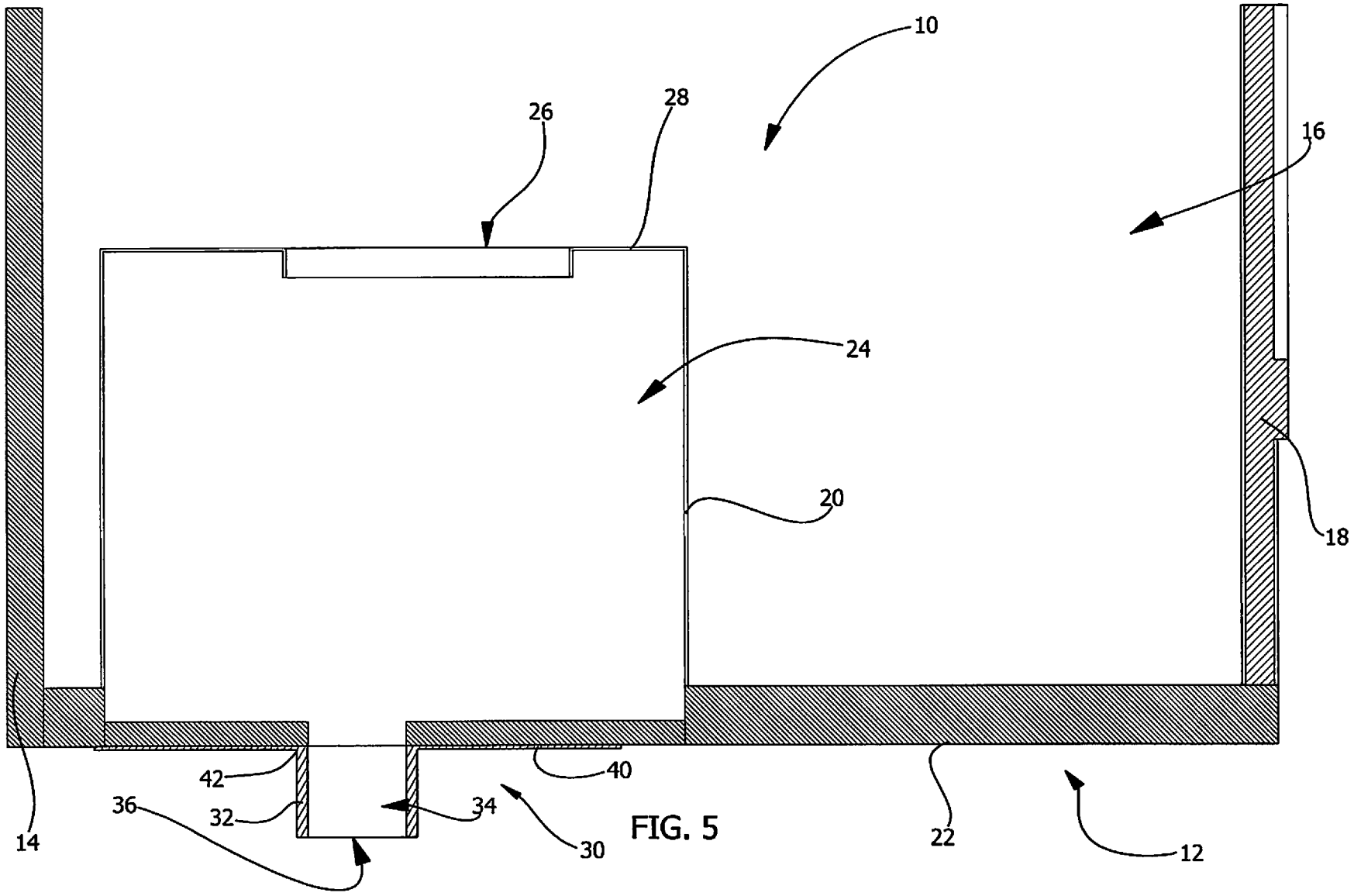
FIG. 5 is a cross-section view of an embodiment of the disclosure taken from Arrows 5-5 in FIG. 4.
Figure 6:
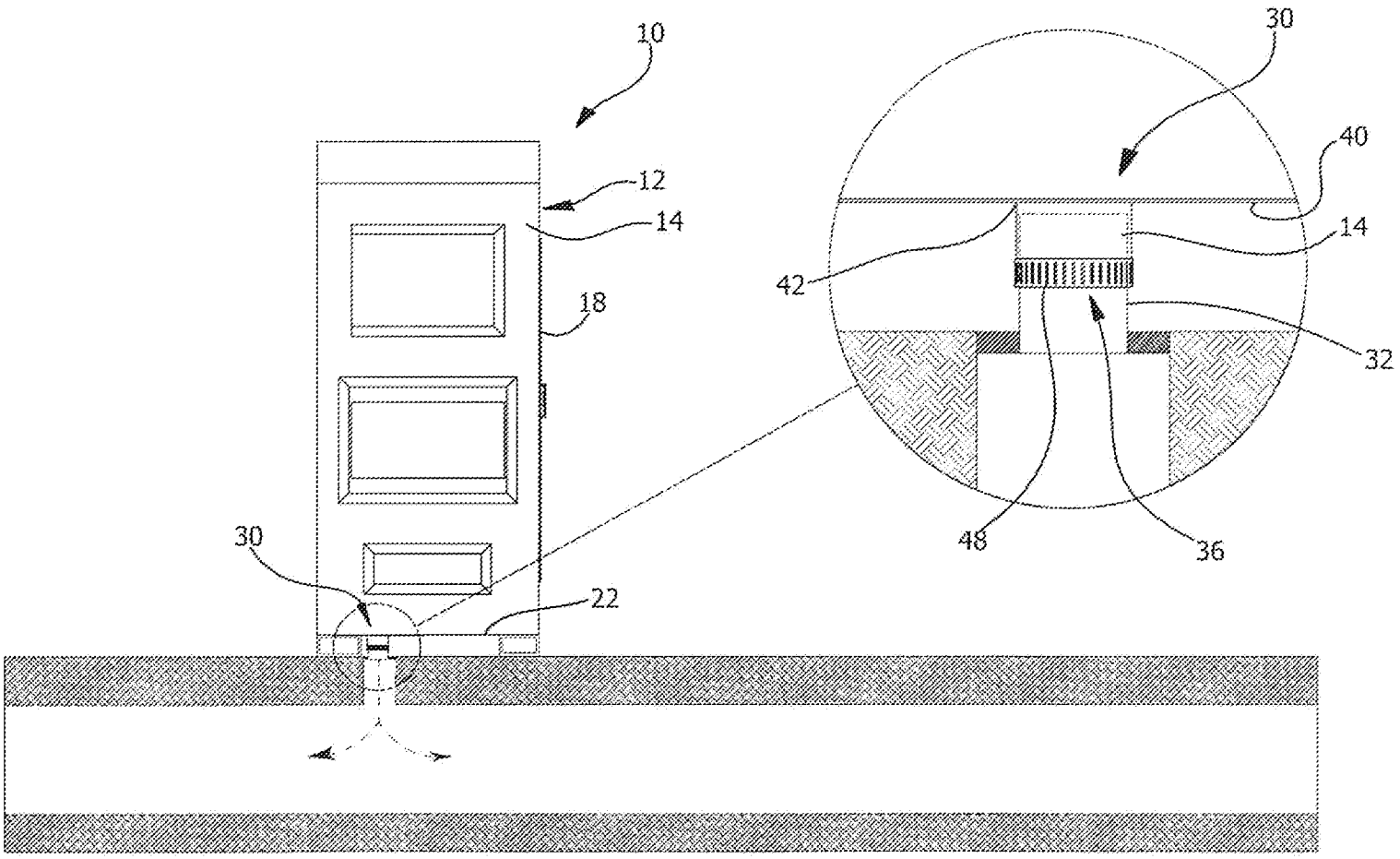
FIG. 6 is an in-use view of an embodiment of the disclosure.

With reference now to the drawings, and in particular to FIGS. 1 through 6 thereof, a new portable toilet embodying the principles and concepts of an embodiment of the disclosure and generally designated by the reference numeral 10 will be described.

As best illustrated in FIGS. 1 through 6, the portable toilet 10 generally comprises an outhouse 12 comprising a housing 14, a door 18, and a waste tank 20. The housing 14 defines an interior space 16 with a size such that the housing 14 is configured for containing a user. The door 18 is mounted to the housing 14 to selectively access the interior space 16 of the housing 14. The waste tank 20 is mounted in the housing 14 and is positioned at a bottom 22 of the housing 14. The waste tank 20 defines a waste chamber 24 therein and has an inlet hole 26 extending downwardly through an upper surface 28 of the waste tank 20 to the waste chamber 24. The upper surface 28 defines a seat configured for supporting a user.

An adapter drain 30 is mounted to the bottom 22 of the housing 14 which comprises a tube 32 defining a channel 34 which is in fluid communication with the waste chamber 24. The tube 32 has an open distal end 36 with respect to the housing 14. An inner diameter of the tube 32 at the open distal end 36 is between 3.0 inches and 4.0 inches. The tube 32 is configured to be in fluid communication with a sewer cleanout pipe 46 and facilitate draining waste from the waste chamber 24 into the sewer cleanout pipe 46. The adapter drain 30 further includes a flange 40 which is coupled to a top end 42 of the tube 32. The flange 40 is coupled to the bottom 22 of the housing 14 via a flange connector 44 comprising an epoxy resin. In other embodiments, the flange connector 44 may be a threaded fastener, a weldment, a clamp, or the like. A tube connector 48 is couplable to the tube 32 such that the tube connector 48 is configured for coupling the tube 32 to the sewer cleanout pipe 46. The tube connector 48 comprises a hose clamp, but may include any conventional pipe fitting, hose fitting, or the like.

In use, the portable toilet 10 is placed over a sewer cleanout pipe 46 and connected to the tube 32 of the adapter drain 30 such that the tube 32 facilitates drainage of waste from the waste chamber 24 to the sewer cleanout pipe 46. The portable toilet 10 may be used to receive evacuated body waste into the waste tank 20, and the body waste is thereafter directed through the sewer cleanout pipe and into a sewer system to which the sewer cleanout pipe 46 is connected.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable toilet comprising:

an outhouse comprising:

a housing defining an interior space with a size such that the housing is configured for containing a user; and a waste tank being mounted in the housing and is positioned on a bottom wall of the housing, the waste tank defining a waste chamber therein, the waste tank having an inlet hole extending downwardly through an upper surface of the waste tank to the waste chamber; and an adapter drain being mounted to the bottom wall of the housing, the adapter drain comprising:

a tube defining a channel which is in fluid communication with the waste chamber, the tube having an open distal end with respect to the housing, the tube being configured to be in fluid communication with a sewer cleanout pipe, the tube being configured to facilitate draining waste from the waste chamber to the sewer cleanout pipe; and a flange being coupled to a top end of the tube, the flange being coupled directly to an exterior side of the bottom wall of the housing.

2. The toilet of claim 1, wherein the tube has an inner diameter at the open distal end of between 3.0 inches and 4.0 inches.

3. The toilet of claim 1, further comprising a flange connector being coupled to the housing and the flange to couple the flange to the housing, the flange connector comprising an epoxy resin.

4. The toilet of claim 1, further comprising a tube connector being couplable to the tube such that the tube connector is configured for coupling the tube to the sewer cleanout pipe.

5. The toilet of claim 4, wherein the tube connector comprises a hose clamp.

6. A portable toilet comprising:

an outhouse comprising:

a housing defining an interior space with a size such that the housing is configured for containing a user;

a door being mounted to the housing to selectively access the interior space of the housing; and a waste tank being mounted in the housing and is positioned at a bottom wall of the housing, the waste tank defining a waste chamber therein, the waste tank having an inlet hole extending downwardly through an upper surface of the waste tank to the waste chamber, the upper surface defining a seat configured for supporting a user;

an adapter drain being mounted to the bottom wall of the housing, the adapter drain comprising:

a tube defining a channel which is in fluid communication with the waste chamber, the tube having an open distal end with respect to the housing, the tube having an inner diameter at the open distal end of between 3.0 inches and 4.0 inches, the tube being configured to be in fluid communication with a sewer cleanout pipe, the tube being configured to facilitate draining waste from the waste chamber to the sewer cleanout pipe; and a flange being coupled to a top end of the tube, the flange being coupled directly to an exterior side of the bottom wall of the housing;

a flange connector being coupled to the housing and the flange to couple the flange to the housing, the flange connector comprising an epoxy resin; and a tube connector being couplable to the tube such that the tube connector is configured for coupling the tube to the sewer cleanout pipe, the tube connector comprising a hose clamp.

* * * * *